United States Patent [19]

Miyazaki et al.

[11] Patent Number: 4,934,275

[45] Date of Patent: Jun. 19, 1990

[54] TRANSFER APPARATUS

[75] Inventors: Masatoshi Miyazaki, Kameyama; Isamu Matsuoka; Yoshiyuki Nakai, both of Suzuka; Masami Murakami, Osaka, all of Japan

[73] Assignees: Honda Giken Kogyo Kabushiki Kaisha; Daifuku Co., Ltd., both of Japan

[21] Appl. No.: 256,419

[22] Filed: Oct. 12, 1988

[30] Foreign Application Priority Data

Jul. 26, 1988 [JP] Japan ..... 63-186518

[51] Int. Cl.[5] ..... B61B 10/02; B61B 13/00

[52] U.S. Cl. ..... 104/91; 104/104

[58] Field of Search ..... 104/89, 91, 94, 96, 104/104, 172.1, 172.4; 105/154, 156, 148; 198/680, 687; 118/423

[56] References Cited

U.S. PATENT DOCUMENTS

| | | | |
|---|---|---|---|
| 3,195,473 | 7/1965 | Dehne | 104/172.4 X |
| 4,341,161 | 7/1982 | Monte et al. | 104/89 X |
| 4,402,265 | 9/1983 | Goto et al. | 118/423 X |
| 4,408,539 | 10/1983 | Wakabayashi | 105/156 X |
| 4,433,628 | 2/1984 | Wakabayashi | 104/172.4 |
| 4,579,062 | 4/1986 | Clark et al. | 104/89 |
| 4,669,388 | 6/1987 | Dehne et al. | 104/96 X |

FOREIGN PATENT DOCUMENTS

| | | | |
|---|---|---|---|
| 0854906 | 11/1952 | Fed. Rep. of Germany | 118/423 |
| 2588837 | 4/1987 | France | 105/148 |
| 2589135 | 4/1987 | France | 105/148 |
| 62-33171 | 7/1987 | Japan . | |
| 0650897 | 3/1979 | U.S.S.R. | 104/89 |

*Primary Examiner*—Andres Kashnikow
*Assistant Examiner*—Mark T. Le
*Attorney, Agent, or Firm*—Barnes, Kisselle, Raisch, Choate, Whittemore & Hulbert

[57] ABSTRACT

An apparatus capable of transferring objects to be transferred, such as car bodies and workpieces, in an inclined state. A support section capable supporting an object to be transferred is supported by three trolleys. These trolleys are guided for travel along the main rail. A pair of subrails branch from the main rail to opposite sides. Of the three trolleys, the one on the front side of the support section remains on the main rail while the other two are capable of moving from the main rail onto the subrails. The relative positions of the main rail and subrails, particularly the vertical positions are changed, whereby the object which is supported on the support is inclined.

12 Claims, 17 Drawing Sheets

TRANSFER APPARATUS

FIELD OF THE INVENTION

The present invention relates to a transfer apparatus used, for example, in an automobile manufacturing plant to support and transfer car bodies or in various plants to support and transfer workpieces, said apparatus being capable of tilting car bodies and workpiece.

BACKGROUND ON THE INVENTION

Conventionally, this kind of transfer apparatus, as disclosed in Japanese Utility Model Application Laid-Open Specification No. 57-123315, has a trolley device having a plurality of trolleys, said trolley device having a hanger attached thereto, a trolley guide rail for supporting and guiding the trolleys, a rail disposed above said first rail for supporting and guiding a driving device. In such transfer apparatus, when a car body suspended by a hanger is moved in a treating liquid, the following has to be considered.

(A) When the car body brought into the treating liquid, it sometimes tends to float, making it necessary to make accurate the entry angle. Conventionally, as disclosed in Japanese Patent Application Laid-Open Specification No. 56-136999, the track is tilted at a predetermined angle to obtain the required entry angle or, besides this arrangement, as disclosed in Japanese Utility Model Publication No. 52-21343, a guide rail is provided depending on the kind of the hanger to obtain the required entry angle.

(B) In order to prevent the car body from taking out a large amount of treating liquid when leaving the treating liquid, it is necessary to make accurate the exit angle. Conventionally, as disclosed in aforesaid Japanese Patent Application Laid-Open Specification No. 56-136999 and Japanese Utility Model Publication No. 52-21343, the exit angle is determined by a track and a guide rail.

(C) When air remains in the car body brought into the treating liquid, the car body leaving the treating liquid is dented under the influence of the hydrostatic pressure or the support position of the car body is deviated. Conventionally, as disclosed in Japanese Patent Application Laid-Open Specification No. 56-136999, a suspender is swung or, as disclosed in Japanese Patent Application Laid-Open Specification No. 56-141883, this problem has been coped with by deforming the conveyor to swing the suspension member.

(D) If the dripping of treating liquid from the car body does not terminate, this treating liquid will be carried to the next liquid tank.

In the various prior art examples described above, since the entry angle and exit angle are restricted to particular values, optimum angles cannot be obtained when handling different car bodies, though there will be no problem when handling the same car bodies. For this reason, when handling differenct car bodies, a manually operable float-preventing device has heretofore been provided to the hanger. According to this arrangement, however, the hanger becomes complicated and large-sized and, moreover, a manual operation, which is troublesome, is required. Further, when a car body is tilted in the treating liquid, a special operating device for swinging the suspender will be required, though such special operating device is not disclosed in Japanese Patent Application Laid-Open Sepcification No. 56-136999. Further, a complicated construction such as a sinuous conveyor will be required, as found in Japanese Patent Application Laid-Open Specification No. 56-141883.

DISCLOSURE OF THE INVENTION

An object of the invention is to provide a transfer apparatus wherein it is made possible by merely attaching a simple arrangement to adjust the lowering angle or lifting angle of a workpiece when the latter is transferred in its tilted position, so that the angles at which a car body supported as by a hanger enters and leaves a treating liquid can be easily adjusted.

To achieve this object, a transfer apparatus according to the invention comprises:

a support section for supporting an object to be transferred,

A front trolley connected to the front middle portion of said support section through first rotary support means such as a trunnion pin, a horizontal arm connected to the rear middle portion of said support section and turnable at its middle around a vertical pin, a pair of rear trolleys connected to the opposite ends of said arm through second rotary support means such as trunnion pins, a main rail adapted to form a transfer path for supporting and guiding said front and rear trolleys, a pair of subrails branching from said main rail at a predetermined point on said transfer path and symmetrically disposed on opposite sides of said main rail to individually support and guide said pair of rear trolleys, the position of said subrails relative to said main rail being adjustable.

According to such arrangement of the invention, in a transfer form in which said front trolley is supported and guided by the main rail and the pair of rear trolleys are supported and guided by the subrails, when the relative positions of the subrails and main rail are adjusted in lowering or lifting the support section by tilting the respective rails, the lowering or lifting angle can be adjusted as desired. Further, even in the case of horizontal transfer, the support section can be tilted through individual trolleys by relatively vertically changing the position of the main rail and subrails. The support section is supported at its front middle portion by the front trolley and at its rear side by the rear trolleys at two points, whereby the transfer of the support section can be effected stably with little sway and twisting moment (rolling phenomenon) can be reduced. The arm is rotatable around the vertical pin while one rear trolley is positioned rearwardly of the pin and the other rear trolley is positioned forwardly of the pin, whereby these rear trolleys can be supported on the main rail. Thereby, only one main rail is enough for support and transfer except at predetermined places.

The adjustment of said lowering and lifting angles can be made by spacing the lowering or lifting start points for the main rail and subrails apart from each other in the direction of transfer and adjusting the distance therebetween.

The transfer apparatus of the invention is suitable for use for passing objects to be transferred, such as car bodies, through a treating liquid in a liquid tank.

In this case, predetermined rail lying level is set and a first location where the subrails alone are upwardly or downwardly displaced relative to said disposition level and a second location where the main rail alone is likewise displaced are continuously defined. Thereby, in the conditions in which a car body or an object to be transferred is tilted by a small vertical displacement, the air sealed in the car body is moved to allow the car body to be liquid-treated throughout its inner surface.

In the exit section for upward travel out of the liquid tank, the transfer path is upwardly tilted and the subrails can be positioned below and then above the level of the main rail. By so doing, the object to be transferred can be tilted at a sharp angle with the rear portion placed below to make it possible for the liquid in the interior of the object to rapidly flow down. Then with the rear portion rapidly lifted, the posture can be controlled for change to a horizontal one.

The support section can be constructed so that it is swingable around a longitudinal horizontal axis. Thereby, the object to be transferred can be swung; thus, the air sealed in the car body immersed in the treating liquid can be moved.

DESCRIPTION OF THE EMBODIMENTS

Figure 1:
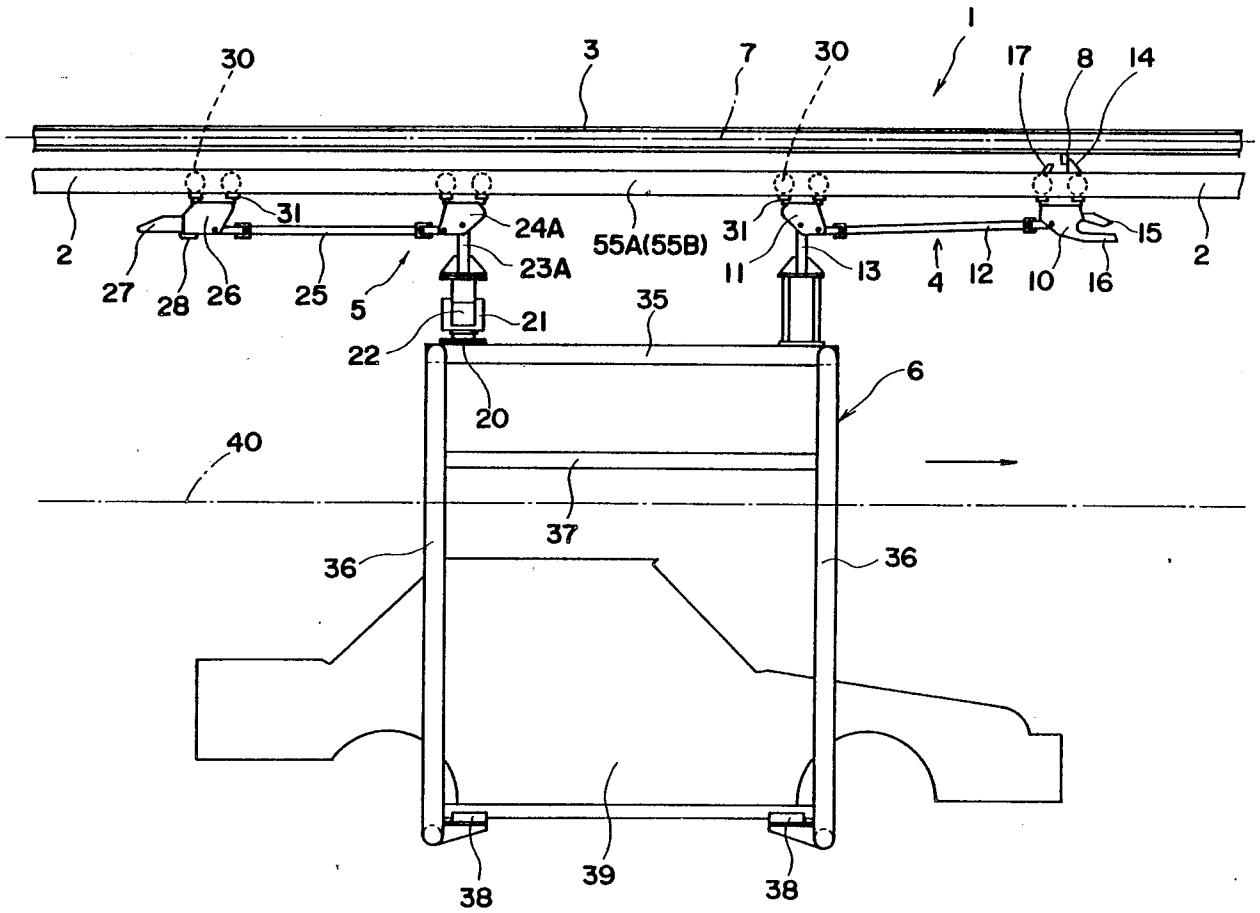
FIG. 1 is a side view of an embodiment of a transfer apparatus of the invention with subrails during use.
Figure 2:
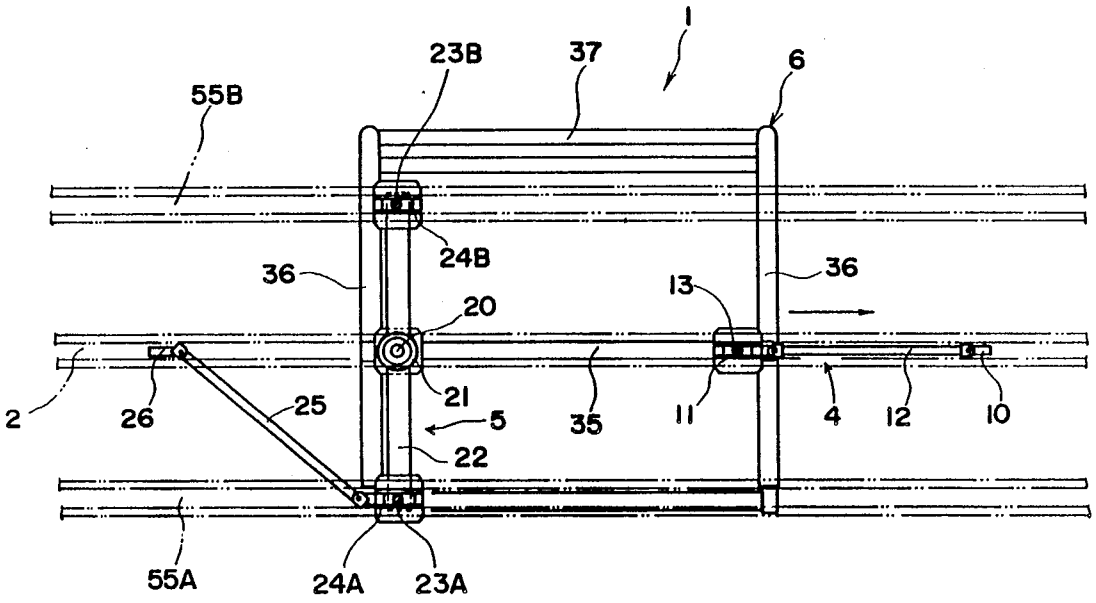
FIG. 2 is a plan view of the apparatus shown in FIG. 1.

In FIGS. 1 through 5, the numeral 1 denotes a suspension transfer apparatus comprising a main rail 2, a driving-device rail 3 laid above said main rail 2, a front trolley device 4 and a rear trolley device 5 which are supported and guided by the main rail 2, a hanger 6 which is an example of a support section attached between said trolley devices 4 and 5, and a driving device (chain conveyor or the like) supported and driven by the driving-device rail 3.

The front trolley device 4 comprises a leading trolley 10, a front trolley 11, and a connecting rod 12 which connects both said trolleys 10 and 11, said front trolley 11 being connected to the front middle portion of the hanger 6 as by a trunnion pin 13. The leading trolley 10 has a risable driven projection 14 adapted to be engaged with a driving projection 8 from the driving device 7, and a forwardly extending actuating lever 15 vertically swingably attached to the trolley 10 intermediate portion thereof. The rear end of the actuating lever 15 is connected to the lower end of the driven projection 14 by a pin so that when the actuating lever 15 is upwardly moved, the driven projection 14 is lowered. The leading trolley 10 has an abutment member 16 positioned below the actuating lever 15 and a holding dog 17 positioned rearwardly of the driven projection 14.

The rear trolley device 5 comprises a vertical pin 20 erected on the rear middle of the hanger 6, an arm 22 attached at its middle to said vertical pin 20 through a bearing 21, a pair of rear trolleys 24A and 24B connected to the opposite ends of said arm 22 through trunnion pins 23A and 23B or the like, and a trailing trolley 26 connected to one rear trolley 24A through a conecting rod 25. The trailing trolley 26 has a rearwardly extending cam tail 27 for upwardly moving the actuating lever 15 of another transfer apparatus 1, the lower side of said cam tail 27 being formed with a abutment portion 28 adapted to abut against the abutment member 16 of another transfer apparatus 1.

Each of the trolleys 10, 11, 24A, 24B and 26 has guide wheels 30 and rolling-preventive wheels 31.

The hanger 6 comprises a connecting frame 35 provided with the trunnion pin 13 and vertical pin 20, a C-shaped hanger sections 36 connected to the front and rear ends of said connecting frame 35 through an upper transverse rod, a longitudinal rod 37 connecting said hanger sections 36, and a plurality of support elements 38 disposed on a lower transverse rod. The numeral 39 denotes a car body which is an example of an object to be transferred, the bottom surface thereof being supported on the support elements 38.

Figure 4:
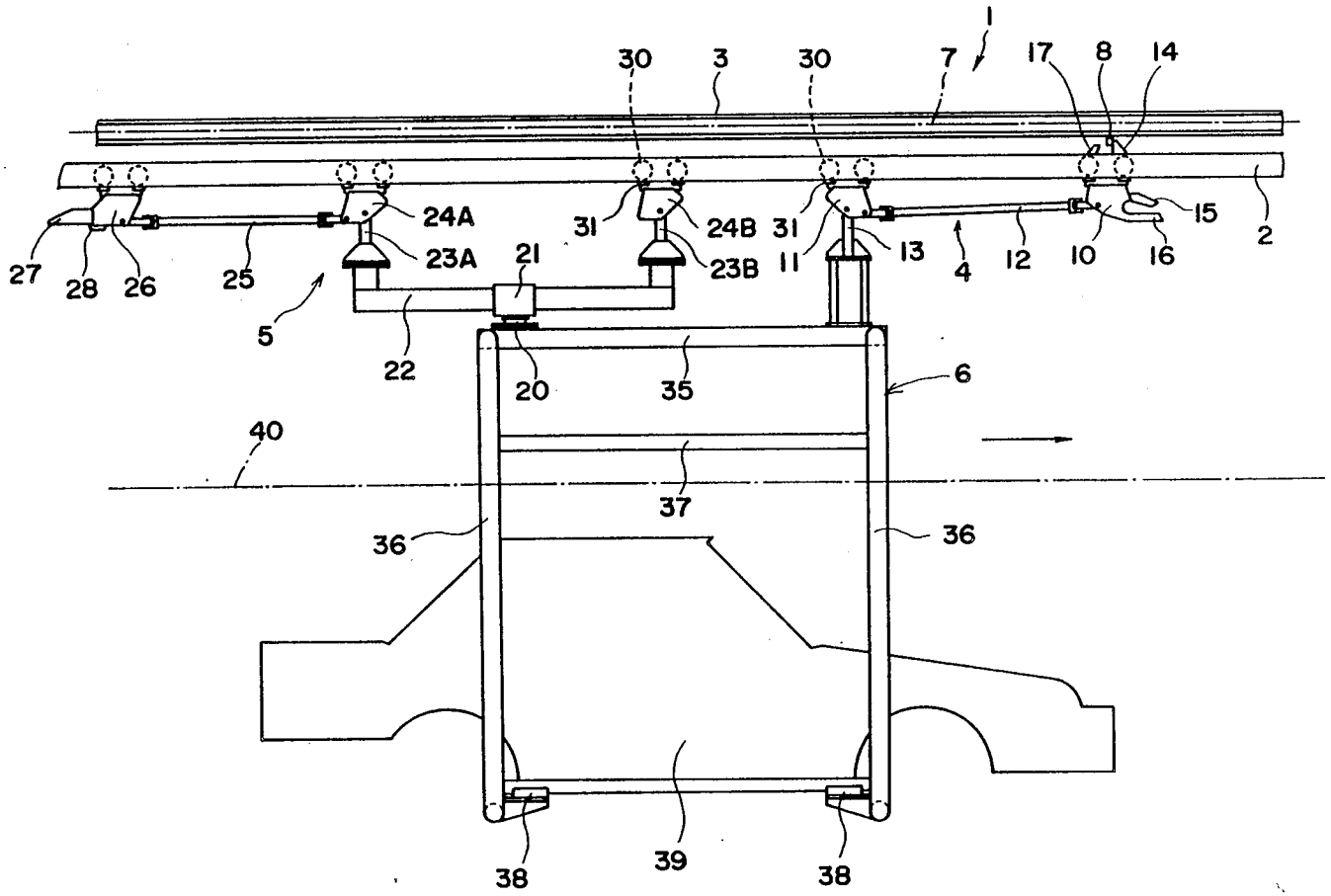
FIG. 4 is a side view of the apparatus of FIG. 1 with the subrails during non-use.
Figure 5:
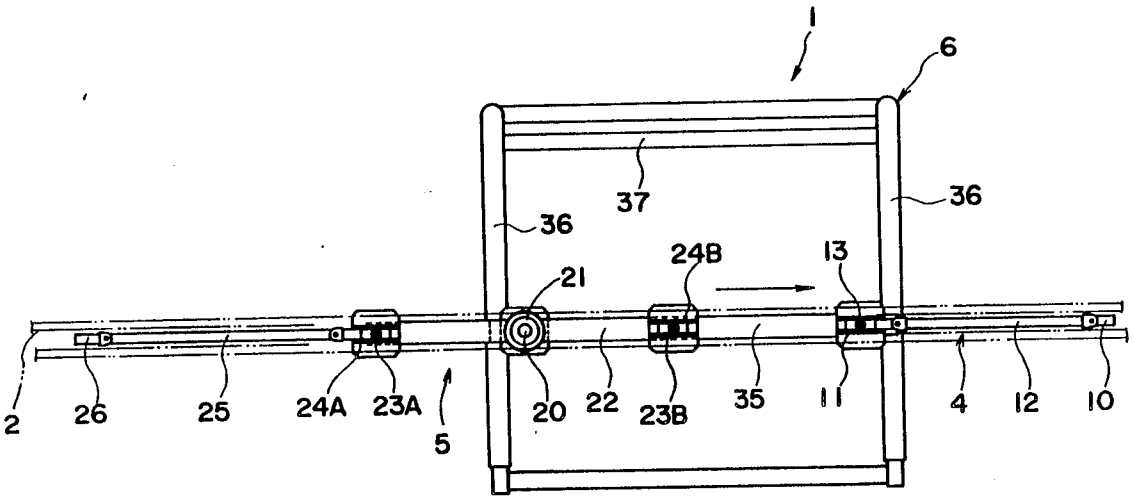
FIG. 5 is a plan view of the apparatus shown in FIG. 4.

According to the suspension transfer apparatus 1 of the above construction, usually, for a travel on a fixed transfer path 40, as shown in FIGS. 4 and 5, the arm 22 is rotated to bring the rear trolley 24B forwardly of the vertical pin 20 and the rear trolley 24A rearwardly of the vertical pin 20 so that all the trolleys 10, 11, 24B, 24A and 26 are supported and guided by the main rail 2, and in this state the driven projection 14 is engaged with the driving projection 8. During travel in this manner, even, if the hanger 6 tries to run in an uncontrolled manner, the holding dog 17 will abut against the driving dog 8, whereby such uncontrolled running is prevented.

Figure 9:
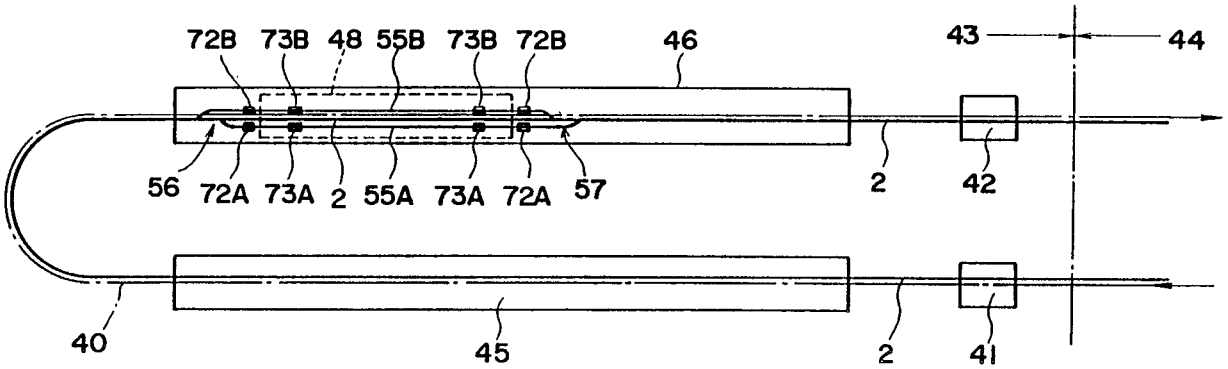
FIG. 9 is a plan view of the entire transfer apparatus of the invention.
Figure 10:
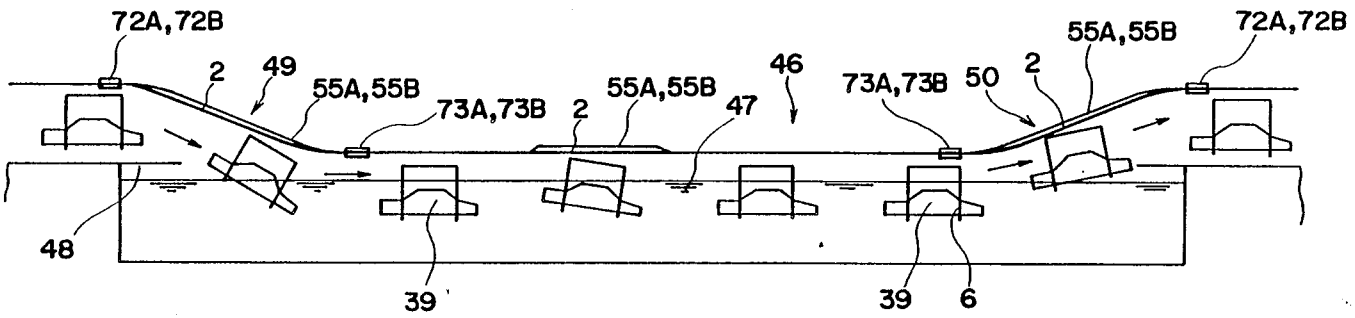
FIG. 10 is a side view showing the treating step in FIG. 9.

As shown in FIGS. 9 and 10, loading and unloading sections 41 and 42 for car bodies 39 are provided in the transfer path 40. The region for supporting and guiding car bodies 39 between both sections 41 and 42 is a work section 43 and the empty transfer region not supporting or guiding car bodies 39 is a storage section 44. Disposed in the portion of the transfer path 40 in the work section 43 are a painting section 45 and a treating section 46. For example, in the treating section 46, there is a liquid tank 48 having a treating liquid 47. The entry portion for this liquid tank 48 in the transfer path 40 is formed as a downwardly inclined path portion 49 and the exit portion is formed as an upwardly inclined path portion 50.

As shown in FIGS. 1 through 3 and FIGS. 6 through 10, in the region where the liquid tank 48 is provided, there are a pair of subrails 55A and 55B symmetrically disposed on opposite sides of the main rail 2 for supporting and guiding a pair of rear trolleys 24A and 24B. A branch section 56 is provided upstream of the downwardly inclined path portion 49 and a meeting section 57 is provided downstream of the upwardly inclined path portion 50.

The branch section 56 comprises a curved intermediate rail 58A connecting one subrail 55A and the main rail 2, an intermediate rail 58B connecting the other subrail 55B and the main rail 2, and switches 59A and 59B disposed at the branch points at the intermediate rails 58A and 58B. The meeting section 57 likewise comprises intermediate rails 60A and 60B and switches 61A and 61B.

Figure 6:
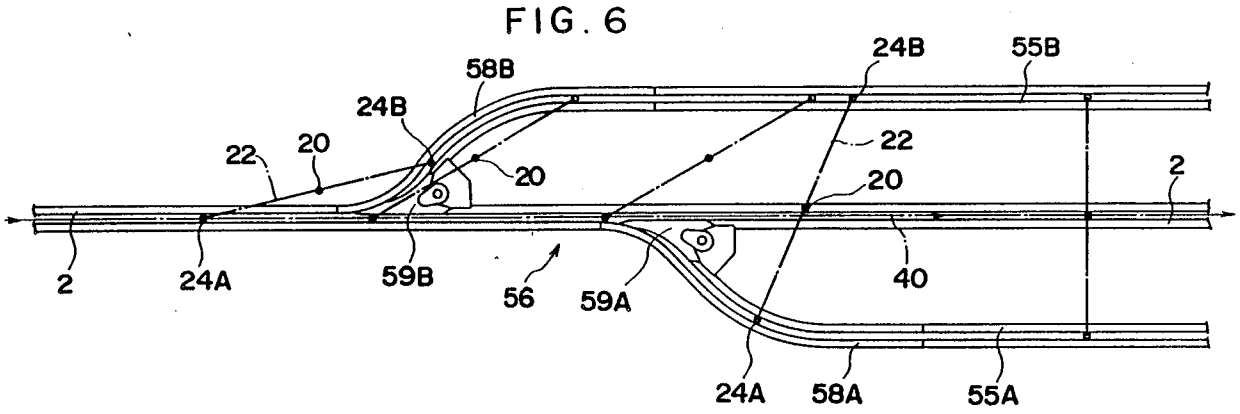
FIG. 6 is a plan view of a branch region.
Figure 7:
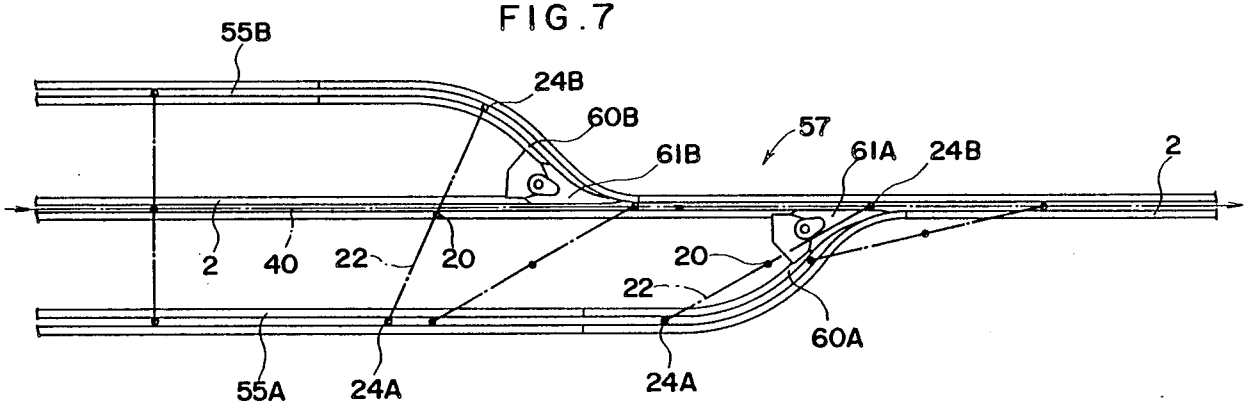
FIG. 7 is a plan view of a meeting region.

According to the above arrangement, in the transfer condition, as shown in FIGS. 4 and 5, in which all the trolleys 10, 11, 24A, 24B and 26 are supported on the main rail 2, when the transfer apparatus 1 reaches the branch section 56 upstream of the liquid tank 48, both trolleys 10 and 11 of the front trolley device 4 are guided by the main rail without branching off. In the rear trolley device, as shown in FIG. 6, the rear trolley 24B disposed in front of the vertical pin 20 is guided to the subrail 55B by the switching operation of the switch 59B. The rear trolley 24A disposed in the rear of the vertical pin 20 passes by the switch 59B which has been restored to its original position, and is then guided to the subrail 55A by the switching operation of the switch 59A. During this operation, the arm 22 is gradually rotated around the vertical pin 20 until it is orthogonal to the transfer path 40. Thus, it follows that the rear portion of the hanger 6 is supported at two places by the rear trolleys 24A and 24B. Therefore, thanks to three-point support including the front trolley 11, the transfer of the hanger 6 can be effected with less sway and with reduced twisting moment (rolling phenomenon).

When reached to the meeting section 57, first the rear trolley 24B meets the main rail 2 and then the rear trolley 24A meets it.

Figure 8:
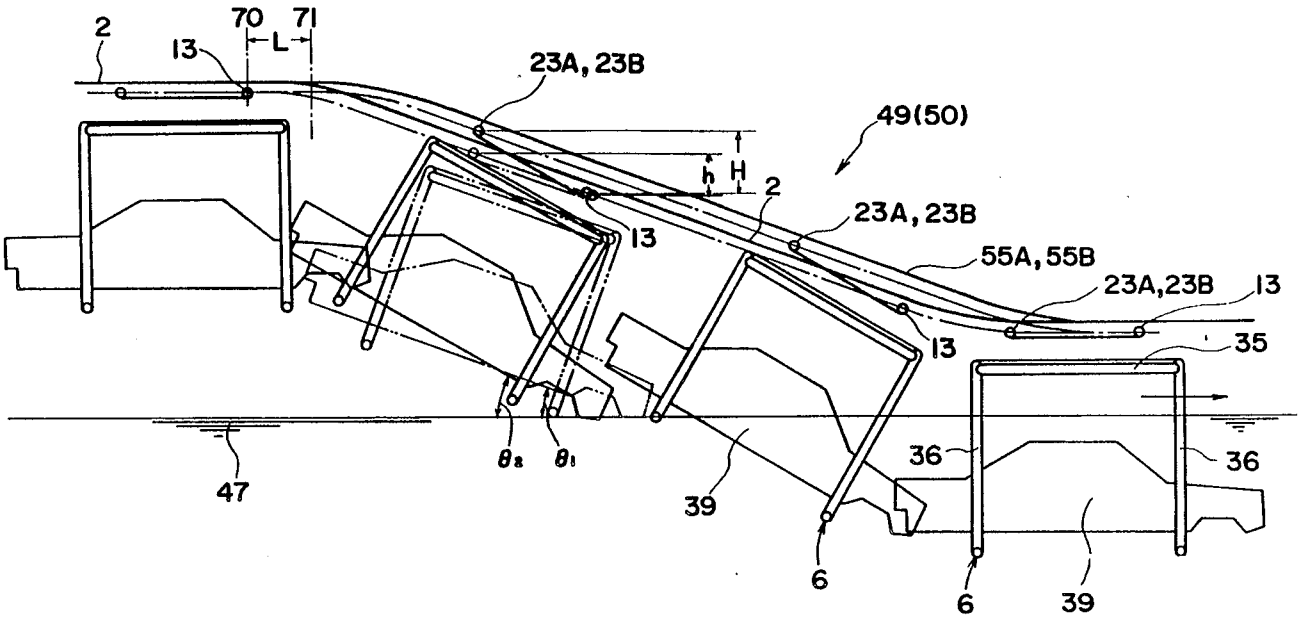
FIG. 8 is a view showing the manner of entry into a liquid.

In the downwardly inclined path portion 49 shown in FIG. 8, a lowering start point 71 for both subrails 55A and 55B is defined on the downstream side at a distance L from a lowering start point 70 for the main rail 2. Thus, when seen in a side view, both subrails 55A and 55B are shifted upward with respect to the main rail 2. Thus, when seen at the positions of the trunnion pins 13 and 23A, 23B, the amount of vertical displacement H between both trunnion pins 13 and 23A, 23B shown in solid line in FIG. 8 can be made greater than the amount of vertical displacement h provided when all the rails have the same lowering start point as shown in phantom lines. Thereby, the entry angle $\theta_2$ shown in solid line can be made greater than the entry angle $\theta_1$ shown in phantom line.

The amount of displacement H, i.e., the entry angle $\theta_2$ can be changed as desired. This can be effected by shifting the lowering start points 71 and the lowering end points for the subrails 55A and 55B as by cutting the subrails and moving the inclined subrail portions in the direction of the transfer path 40 and connecting them to the cut ends by means of coupling slide rail devices 72A, 72B, 73A and 73B shown in FIGS. 9 and 10 to displace the positions of the lowering. start points 71, and changing the distances L. Slide rail devices 72A, 72B, 73A and 73B can maintain the functional continuities of the subrails 55A and 55B even if the subrail portions between both slide rail devices 72A, 72B, 73A and 73B are moved in the direction of the transfer path 40. The construction of these slide rail devices is known by, for example, Japanese patent document laid open to public inspection under No. 62-33171 (Japanese patent application No. 55-144601).

Figure 3:
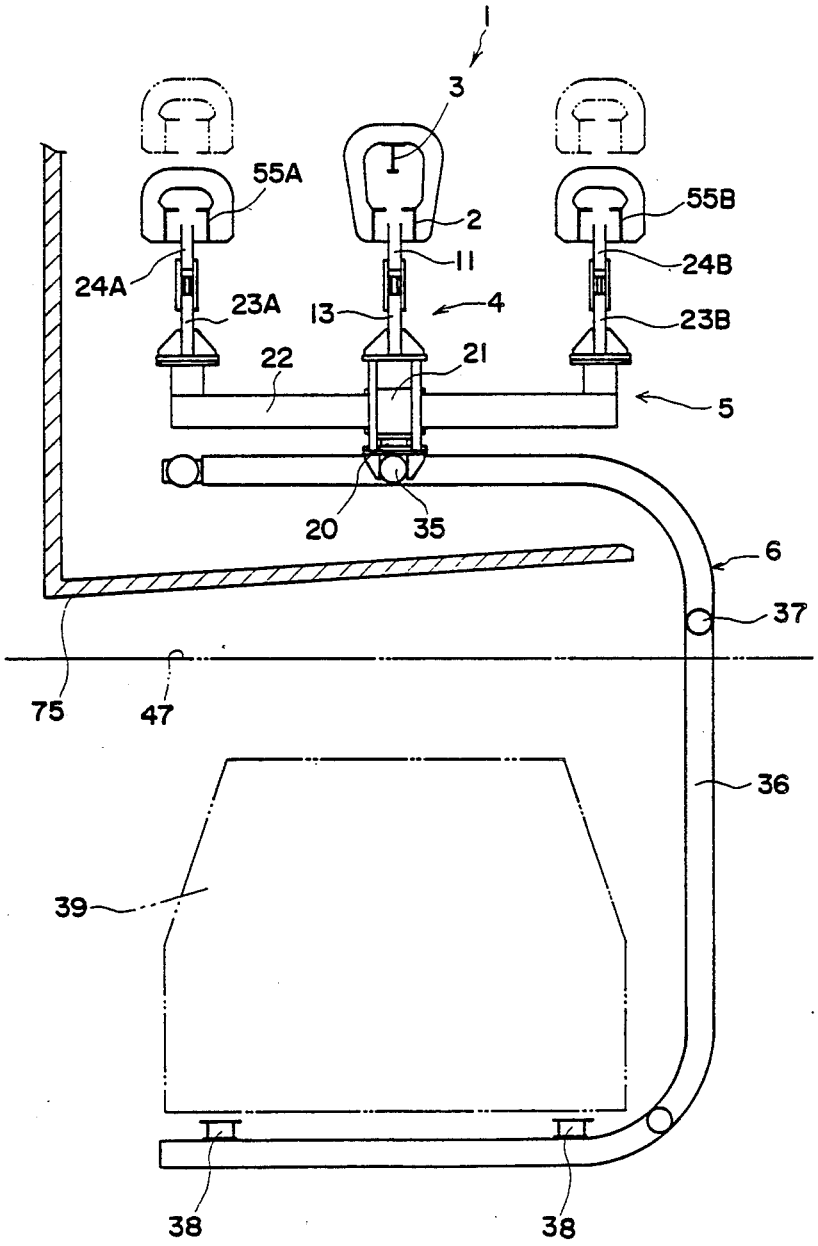
FIG. 3 is a front view of the apparatus shown in FIG. 1.

For example, with car body 39 immersed in the treating liquid 47, both subrails 55A and 55B are upwardly displaced with respect to the main rail 2 as shown in phantom lines in FIG. 3 and FIG. 10, whereby the rear trunnion pins 23A and 23B are lifted with respect to the front trunnion pin 13, thus tilting the car body 39 in a vertical plane through the hanger 6. This tilting operation makes it possible to remove the air remaining in the car body 39. In addition, the dripping of treating liquid from the car body can be terminated by tilting the car body 39 as described above when it leaves the treating liquid 47. Such operation will be later described in more detail.

FIG. 3 shows a cover 75 for preventing foreign matter, such as oil, which has fallen as from both trolley devices 4 and 5, from falling onto the car body 39 or into the treating liquid 47.

In the above embodiment, the suspension transfer apparatus 1 using the hanger 6 as a support section has been shown; however, it may be a floor truck with a mount installed between the upper portions of the trolley devices 4 and 5. Further, in the above embodiment, there has been shown an arrangement provided with the leading and trailing trolleys 10 and 26 through connecting rods 12 and 25; however, one or both of them may be omitted if objects to be transferred are short in length. In that case, the front trolley 11 will be provided with a driven projection 14 or the like while the rear trolleys 24A and 24B will each provoided with a cam tail 27 or the like.

Figure 11:
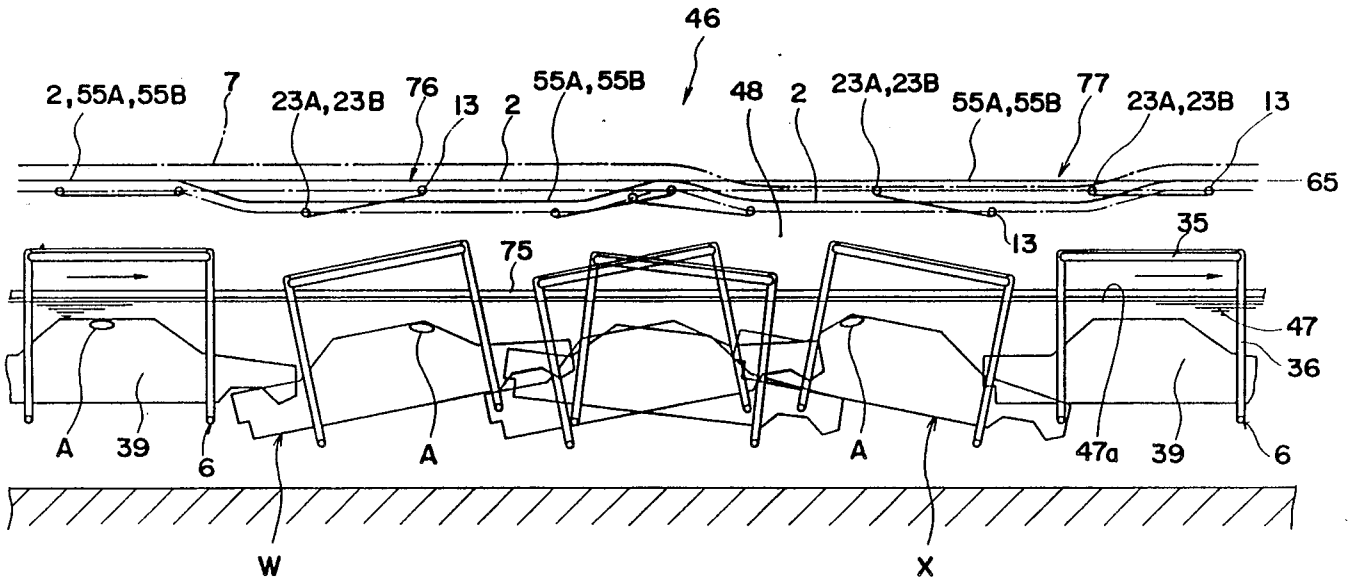
FIG. 11 is a side view of the middle portion of a liquid tank in a first modified embodiment of a transfer apparatus of the invention.
Figure 12:
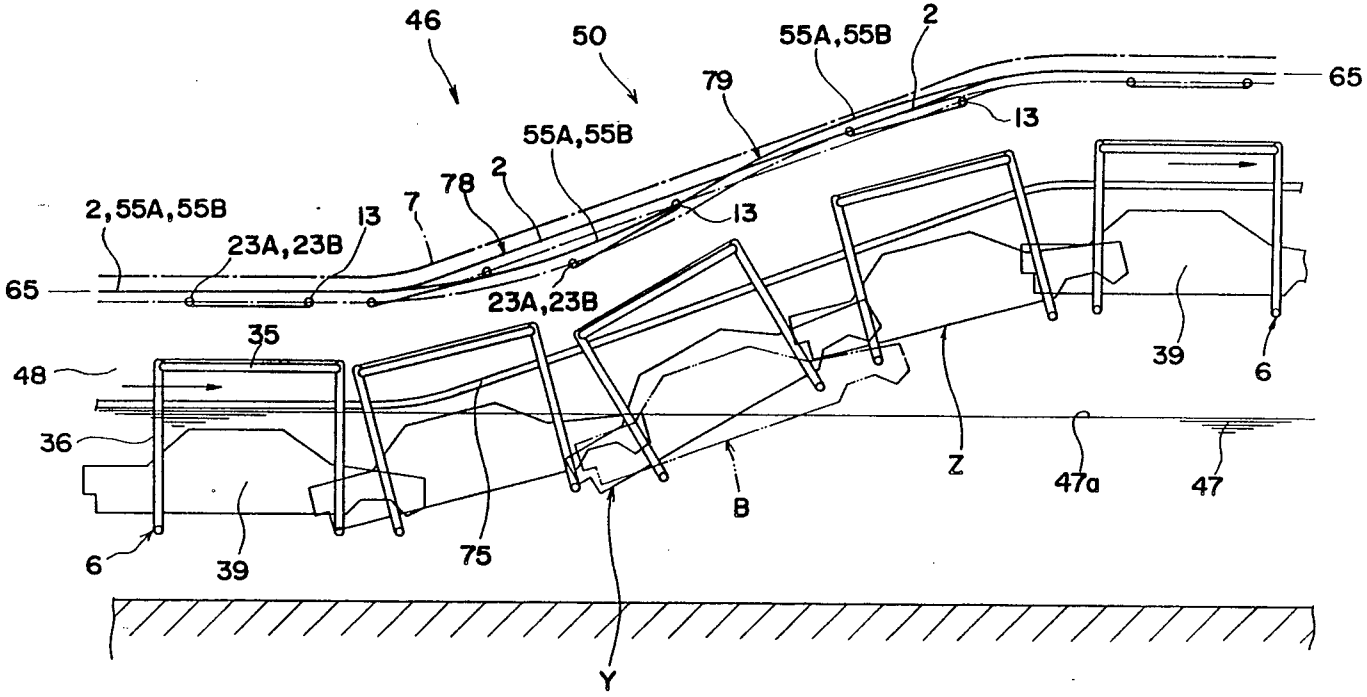
FIG. 12 is a side view of the exit section of the liquid tank shown in FIG. 11.
Figure 13:
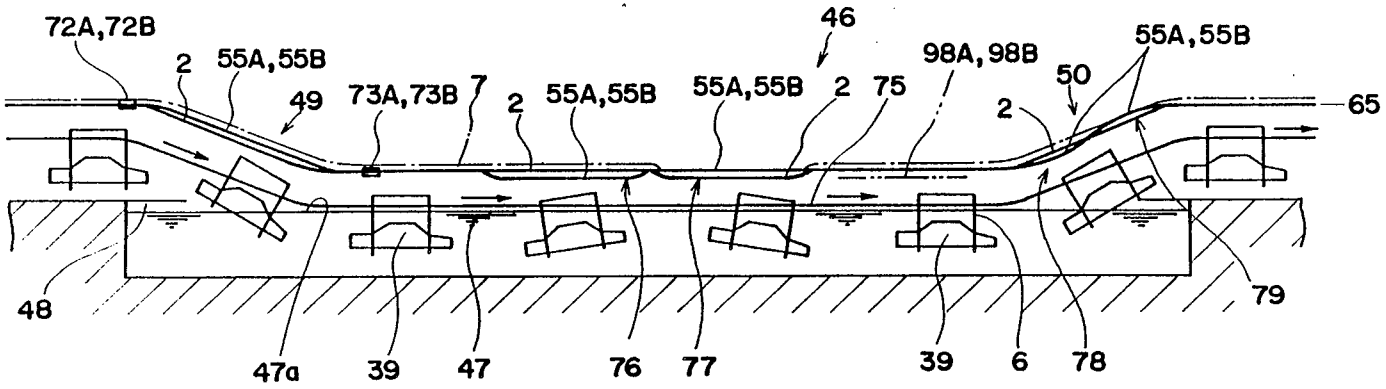
FIG. 13 is a side view of the liquid tank shown in FIG. 11 in its entirety.

FIGS. 11, 12 and 13 shows a first modified embodiment of a transfer apparatus of the invention. In a portion of the liquid treatment section 46 excluding the downwardly inclined path portion (entry section) 49 and the upwardly inclined path portion (exit section) 50, there are continuously defined a rear lowering location 76 with both subrails 55A and 55B disposed low with respect to the rail laying level 65 (position of the main rail 2) and a front lowering location 77 with the main rail disposed low with respect to the rail laying level 65 (the positions of the subrails 55A and 55B). Between both locations 76 and 77, the rails 2, 55A and 55B are positioned at the rail laying level 65. Further, in the upwardly inclined path portion (exit section) 50 of the treating section 46, both subrails 55A and 55B are disposed at their front halves in the lower laying location 78 and at their rear halves in the upper laying location 79 with respect to the main rail 2 which disposed in the inclined position. In the treating section 46, the receiving cover 75 is disposed somewhat above the liquid surface **47*a* and parallel with the rail laying level 65**.

The car body 39 immersed in the treating liquid 47 via the downwardly inclined path portion 49 is moved horizontally through the treating liquid 47 for intended liquid treatment since the rails 2, 55A and 55B are at the rail laying level 65. However, because of the presence of air A sealed in the car body 39 as shown in FIG. 11, the inner surface portion where the air A exists is not liquid-treated. At this time, in the rear lowering location 76, the front trolley 11 is supported and guided by the main rail 2 which is at the same level as the rail laying level 65; however, since the rear trolleys 24A and 24B are supported and guided by the subrails 55A and 55B disposed below the rail laying level 65, the hanger 6 is tilted rearward by the corresponding amount. Therefore, the car body 39 supported by the hanger 6 is tilted so that its rear portion lowers as shown at W in FIG. 11, and since the air A sealed in moves toward the front side, the inner surface portion where the air A existed is liquid-treated. Subsequently, both trolleys 11 and 24A, 24B are moved to the front lowering location 77. In this location, front trolley 11 is supported and guided by the main rail 2 disposed below the rail laying level 65 and the rear trolleys 24A and 24B are supported and guided by the subrails 55A and 55B disposed at the same level as the rail laying level 65; therefore, the hanger 6 is tilted forward by the corresponding amount. Therefore, the car body 39 supported by the hanger 6 is tilted so that its front portion lowers as shown at X in FIG. 11, and the air A sealed in moves to the rear side.

In this manner, the car body 39 is tilted so that first its rear portion lowers and then its front portion lowers, and during this tilting operation, since either the main rail 2 or the subrails 55A and 55B at the rail laying level 65, the front or rear portion of the car body 39 is maintained at a level spaced substantially a constant distance from the rail laying level 65 with the other rear or front portion titled somewhat lower. As a result, it becomes possible for the car body 39 to tilt or swing over a small vertical distance. Therefore, the receiving cover 75 can be disposed linearly irrespectively of the movement of the car body 39 and the liquid tank 48 can be made shallower.

The car body 39 having passed through the liquid treatment comes out via the upwardly inclined path portion 50. At this time, in the lower laying location 78 which is the first half of the upwardly inclined path portion 50, the rear trolleys 24A and 24B supported and guided by the subrails 55A and 55B can be disposed lower than the usual rail laying level 65 with respect to the front trolley 11 supported and guided by the main rail 2; therefore, the hanger 6 can be tilted at a correspondingly sharp angle. Therefore, the car body 39 supported by the hanger 6 is brought out of the treating liquid 47 at a sharper angle than that of a car body B in a conventional case, as shown at Y. Thanks to this sharp angle inclination, as the car body 39 exits from the liquid surface 47*a*, the treating liquid 47 in the interior of the car body rapidly flows down. In the upper laying location (rear half) 79 where entire or substantially entire car body 39 has left the treating liquid 47, the rear trolleys 24A and 24B supported and guided by the subrails 55A and 55B can be disposed above the rail laying level 65, the rear portion of the hanger 6 is lifted by the corresponding amount. Therefore, the car body is supported by the hanger 6 has its posture controlled to assume the horizontal posture with its rear portion rapidly lifted, as shown at Z in FIG. 12. Thereby, the treating liquid 47 remaining in the rear portion of the car body 39 is rapidly discharged while terminating the dripping of treating liquid from the car body 39. In this manner, in the exit section, the car body 39 can be swung to the posture which facilitates discharge of the liquid, making it possible to effect economical exit with a minimum of treating liquid taken out. Further, a path for terminating the dripping of liquid is not required, and hence the size of the liquid tank 48 can be reduced.

FIGS. 14 through 20 show a second modified embodiment of a transfer apparatus of the invention. In FIGS. 14 through 17, the front trolley 11 is connected to the front middle portion of the hanger 6 through a trunnion pin 13, an insulator 18 and a front connector 63 so that it is relatively swingable around a longitudinally extending horizontal axis 64. The front connector 63 comprises an upper flange 82 made integral with the lower portion of the insulator 18, a lower flange 66 made integral with the upper portion of the hanger 6, said flanges 82 and 66 being connected together by a longitudinal pin 67, so that the flanges 82 and 66 are relatively swingable around the longitudinally extending horizontal axis 64.

Figure 18:
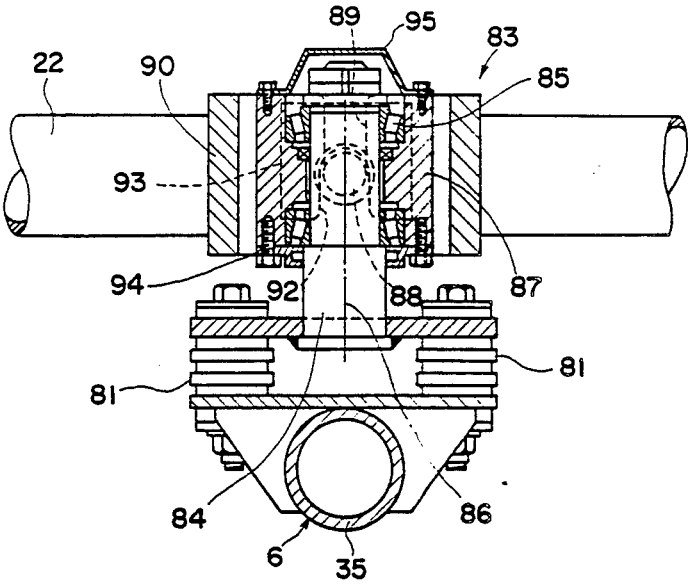
FIG. 18 is a side view in section, showing in detail a rear connector in FIG. 14.
Figure 19:
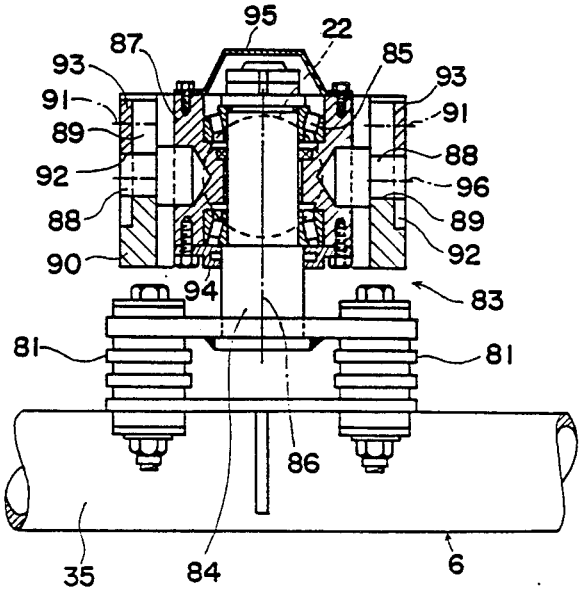
FIG. 19 is a front view, in section, of the rear connector shown in FIG. 18.
Figure 20:
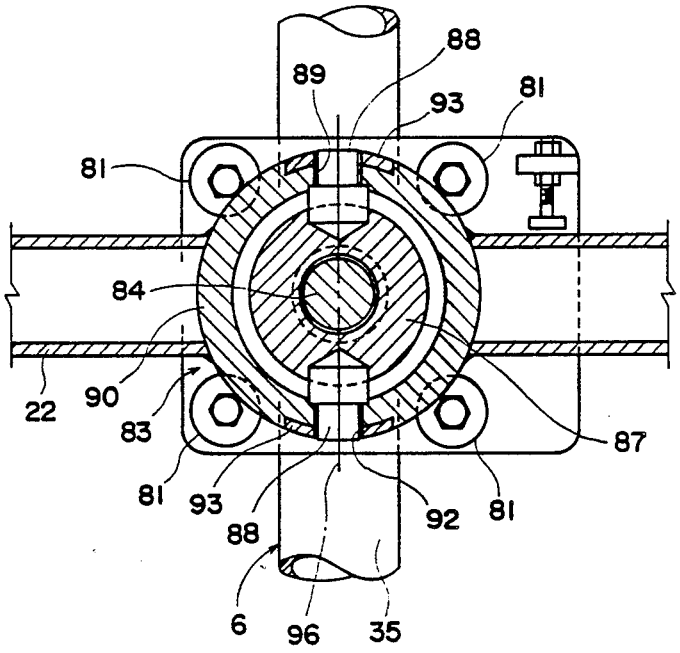
FIG. 20 is a plan view, in section, of the rear connector shown in FIG. 18.

In the rear trolley device 5, an arm 22 is connected at its middle to the rear connector 83, the latter being attached to the rear middle portion of the hanger 6 through the insulator 81. As shown in FIGS. 18 through 20, the rear connector 83 comprises a vertical pin 84 vertically extending from the insulator 81, an inner cylindrical body 87 fitted on said vertical pin 84 through bearings 85 for relative rotation around its axis 86, horizontal transverse pins 88 outwardly projecting from two dimetrically opposite places on said inner cylindrical body 87, an outer cylindrical body 90 disposed around said inner cylindrical body 87 at a place radially spaced from said inner cylindrical body 87 and each having a U-shaped notch 89 allowing insertion therein of the transverse pin 88, key plates 93 removably attached to said outer clyindrical body 90 by bolts 91 and each having an inverted U-shaped notch 92 allowing insertion therein of the transverse pin 88, a cover 94, and a cap 95. The arm 22 is connected to the outer surface of the outer cylindrical body 90 in the direction orthogonal to the transverse pins 88. As a result, the hanger 6 and the arm 22 are connected so that they are relatively swingable around a horizontal axis 96 which is orthogonal to the direction of the length of the arm 22. The upper opposite sides of the hanger 36 are provided with rollers 34A and 34B for receiving downward forces from cam rails 98A and 98B (FIG. 16).

Figure 14:
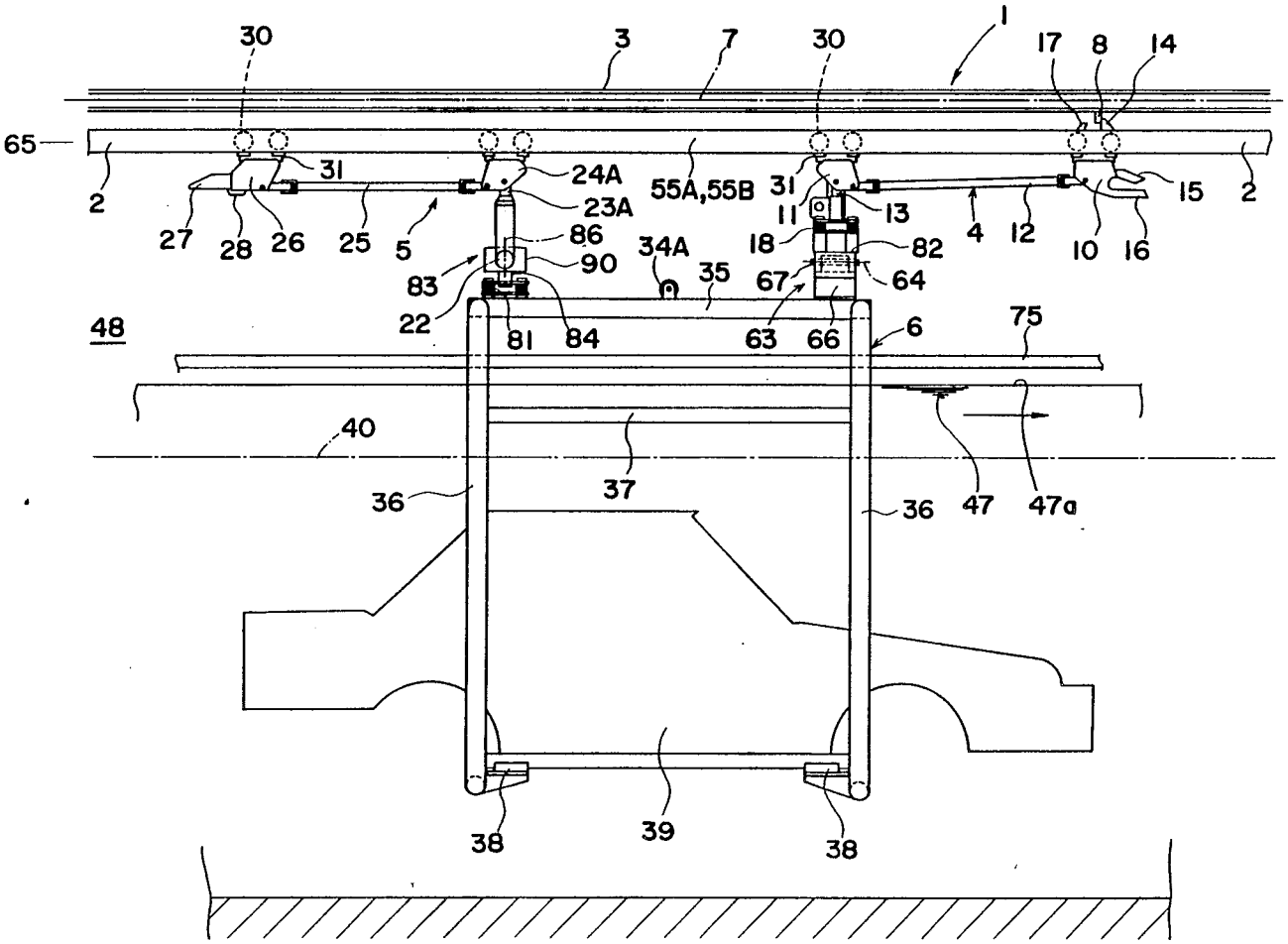
FIG. 14 is a side view of a second modified embodiment of a transfer apparatus of the invention with subrails during use.
Figure 15:
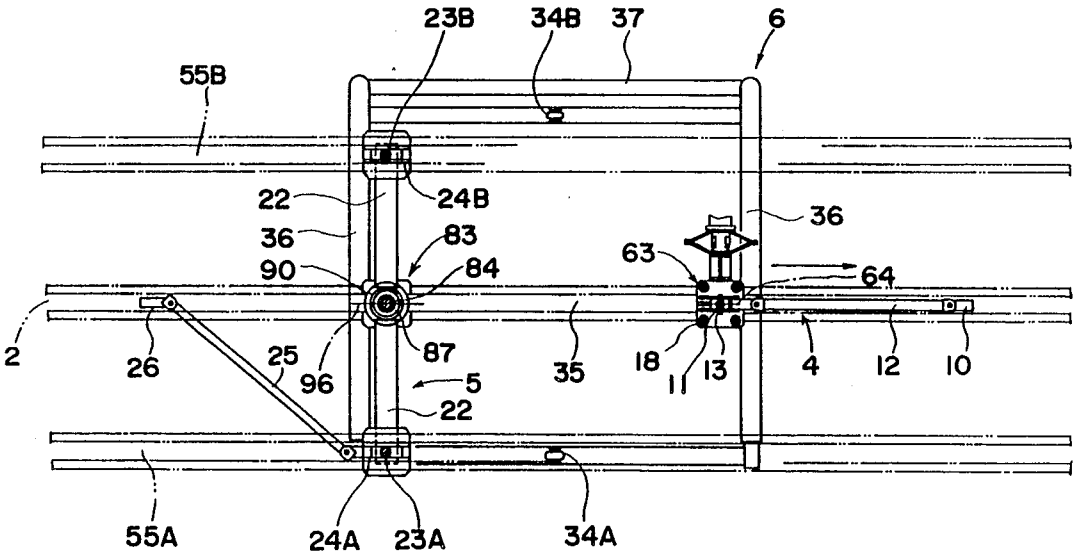
FIG. 15 is a plan view of the apparatus shown in FIG. 14.
Figure 16:
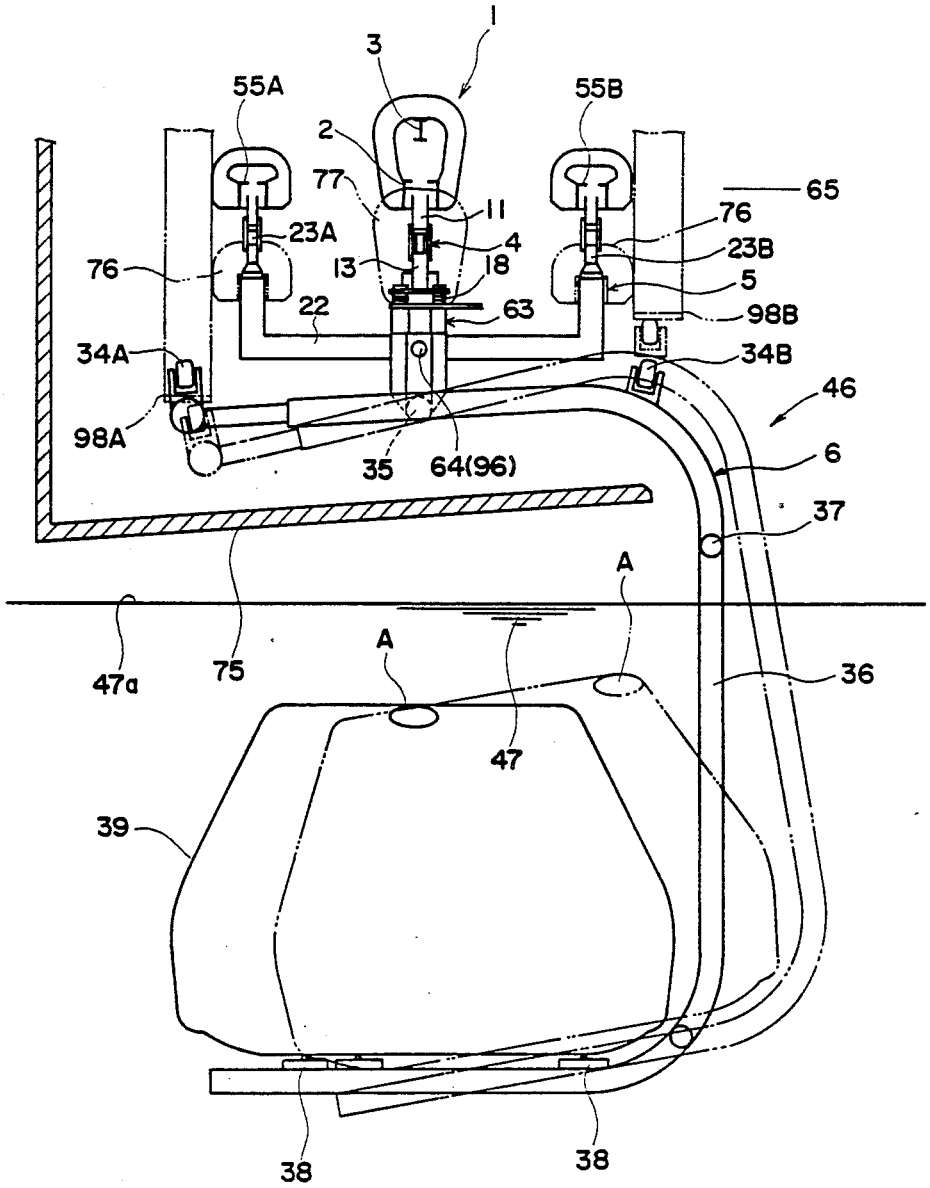
FIG. 16 is a front view of the apparatus shown in FIG. 14.
Figure 17:
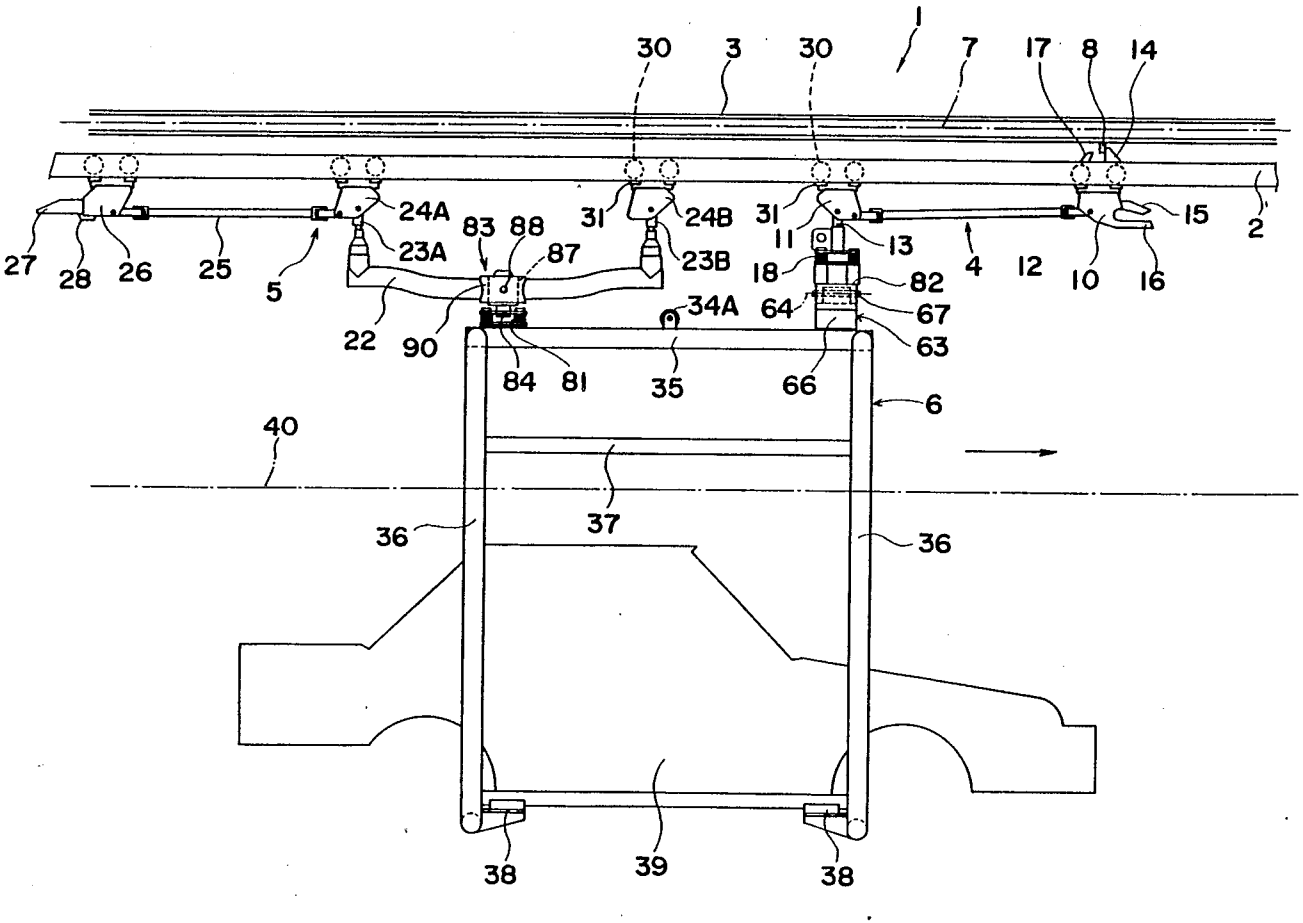
FIG. 17 is a side view shown in FIG. 14 with the subrails during non-use.

According to the suspension transfer apparatus 1 of the above construction, usually, for a travel on a fixed transfer path 40, as shown in FIG. 17 and in the same manner as in FIG. 4, the arm 22 is rotated around the vertical axis 86 to bring the rear trolley 24B forwardly of the vertical pin 84 and the rear trolley 24A rearwardly of the vertical pin 84 so that all the trolleys 10, 11, 24B, 24A and 26 are supported and guided by the main rail 2. Further, the traveling state which is established when the rear trolleys 24A and 25B are guided by the subrails 55A and 55B is as shown in FIGS. 14 through 16.

As shown in phantom lines in FIG. 16 and in FIG. 13 utilized for description of the first modified embodiment of the invention, cam rails 98A and 98B for depressing the side of the hanger 6 are installed at suitable places in the treating section 46. Therefore, at said suitable places, the rollers 34A and 34B come under the lower surfaces of the cam rails 98A or 98B, producing downward forces on one side of the hanger 6, whereby the hanger 6 is swung around the axes 64 and 96. Therefore, the car body 39 supported by the hanger 6 also swings, so that the air A sealed therein moves toward opposite sides, a fact which means that the inner surface portion where the air A existed is liquid-treated.

In addition, the hanger 6, that is, the car body 39 can be three-dimensionally tilted and swung by causing the subrails 55A, 55B and cam rails 99A, 99B to act at the same time.

In the case where all the trolleys 10, 11, 24A, 24B and 26 are to be supported and guided by the main rail 2 in the usual transfer path, the arm 22 extends in the longitudinal direction and the transverse pin 88 which is at right angles with the arm 22 extends in the transverse direction; thus, transverse sway of the support 6 can be prevented.

What is claimed is:

1. An apparatus for transferring objects to be transferred comprising:

a support section for supporting an object to be transferred, a front trolley connected to the front middle portion of said support section through first rotary support means including a trunnion pin, a horizontal arm connected to the rear middle portion of said support section and turnable around a vertical pin at the middle portion of said horizontal arm, a pair of rear trolleys connected to the opposite ends of said arm through second rotary support means including trunnion pins, a main rail adapted to form a transfer path for supporting and guiding said front and rear trolleys, and a pair of subrails branching from said main rail at a predetermined point on said transfer path and symmetrically disposed on opposite sides of said main rail to individually support and guide said pair of rear trolleys, a rocking means constituted by each of said subrails having continuously a location where the subrail is displaced relatively upward with respect to said main rail and a location where the subrail is displaced relatively downward with respect to said main rail, thereby to rock the supported object in the direction of transfer.

2. An apparatus as set forth in claim 1, wherein said main rail and subrails have respectively inclined portions including lowering start points, said lowering start points for the main rail and subrails are spaced apart from each other in the direction of transfer, and the main rail and subrails are arranged so that the distance between the lowering start points is adjustable by an adjustable means.

3. An apparatus as set forth in claim 1, wherein said main rail and subrails have respectively inclined portions including lifting start points, said lifting start points for the main rail and subrails are spaced apart from each other in the direction of transfer, and the main rail and subrails are arranged so that the distance between the lifting start points is adjustable by an adjustable means.

4. An apparatus as set forth in claim 1, wherein:

the transfer path has a treating section in which the object to be transferred is passed through a treating liquid contained in a liquid tank, a predetermined rail laying level is set in the region where the object is transferred in the treating liquid, and a first location where the subrails alone are displaced downward with respect to said rail laying level and a second location where the main rail alone is displaced downward with respect to said rail laying level are continuously defined.

5. An apparatus as set forth in claim 1, wherein:

the transfer path has a treating section in which the object to be transferred is passed through a treating liquid contained in a liquid tank, a predetermined rail laying level is set in the region where the object is transferred in the treating liquid, and a first location where the subrails alone are displaced upward with respect to said rail laying level and a second location where the main rail alone is displaced upward with respect to said rail laying level are continuously defined.

6. An apparatus as set forth in claim 1, wherein:

the transfer path has a treating section in which the object to be transferred is passed through a treating liquid contained in a liquid tank, a predetermined rail laying level is set in the region where the object is transferred in the treating liquid, and a first location where the subrails alone are displaced downward with respect to said rail laying level and a second location where the subrails alone are displaced upward with respect to said rail laying level are continuously defined.

7. An apparatus as set forth in claim 1, wherein:

the transfer path has a treating section in which the object to be transferred is passed through a treating liquid contianed in a liquid tank, a predetermined rail laying level is set in the region where the object is transferred in the treating liquid, and a first location where the main rail alone is displaced downward with respect to said rail laying level and a second location where the main rail alone is displaced upward with respect to said rail laying level are continuously defined.

8. An apparatus as set forth in claim 1, wherein:

the transfer path has a treating section in which the object to be transferred is passed through a treating liquid contained in a liquid tank, and a cover for receiving foreign matter falling from the trolleys is installed between the trolleys and the surface of the treating liquid at a level above the liquid surface and in parallel relation to the rail laying level.

9. An apparatus as set forth in claim 1, wherein:

the transfer path has a treating section in which the object to be transferred is passed through a treating liquid contained in a liquid tank, and in the exit section in the treating section, the transfer path is upwardly inclined while the subrails are disposed first above and then below the main rail.

10. An apparatus as set forth in claim 1, wherein:

the support section includes means for allowing said support section to be rotatable around a first horizontal axis with respect to the front trolley and around a second horizontal axis with respect to the arm, said second horizontal axis extending in the direction orthogonal to the arm, and said apparatus has means for depressing one side of the support section, whereby said support section is adapted together with said object to be rotatable in the direction orthogonal to the transfer direction at the place where the transfer path has said subrails at both sides.

11. An apparatus as set forth in claim 10, wherein:

the transfer path has a treating section in which said object is passed through a treating liquid contained in a liquid tank, and said depressing means is associated with said treating section.

12. An apparatus as set forth in claim 11, wherein:

said depressing means comprises a cam rail installed in a portion of the transfer path and having a lower surface, and a roller adapted to come under the lower surface of said cam rail to receive a depressing force from said cam rail.

* * * * *